US012187389B2

(12) United States Patent
Rogers et al.

(10) Patent No.: US 12,187,389 B2
(45) Date of Patent: Jan. 7, 2025

(54) PERSONAL WATERCRAFT

(71) Applicant: Polaris Industries Inc., Medina, MN (US)

(72) Inventors: Erik Rogers, Cadillac, MI (US); Michael T. Yobe, Knoxville, TN (US)

(73) Assignee: Polaris Industries Inc., Medina, MN (US)

( * ) Notice: Subject to any disclaimer, the term of this patent is extended or adjusted under 35 U.S.C. 154(b) by 504 days.

(21) Appl. No.: 17/676,314

(22) Filed: Feb. 21, 2022

(65) Prior Publication Data

US 2022/0266951 A1 Aug. 25, 2022

Related U.S. Application Data

(60) Provisional application No. 63/152,685, filed on Feb. 23, 2021.

(51) Int. Cl.

| | |
|---|---|
| ***B63B 3/48*** | (2006.01) |
| ***B63B 5/24*** | (2006.01) |
| ***B63B 29/04*** | (2006.01) |
| ***B63H 20/02*** | (2006.01) |
| ***B63H 21/21*** | (2006.01) |
| ***B63H 25/02*** | (2006.01) |

(52) U.S. Cl.

CPC ..... *B63B 3/48* (2013.01); *B63B 5/24* (2013.01); *B63B 29/04* (2013.01); *B63H 20/02* (2013.01); *B63H 21/213* (2013.01); *B63H 25/02* (2013.01); *B63B 2029/043* (2013.01)

(58) Field of Classification Search

CPC .. B63B 3/48; B63B 5/24; B63B 29/04; B63B 2029/043; B63B 19/08; B63B 34/00; B63B 2001/186; B63B 2001/201; B63B 2003/145; B63B 2019/083; B63B 3/34; B63B 3/36; B63B 3/26; B63H 20/02; B63H 21/213; B63H 25/02

See application file for complete search history.

(56) References Cited

U.S. PATENT DOCUMENTS

2007/0118493 A1* 5/2007 Jaffe ..... A63H 27/007 706/25

2015/0336633 A1* 11/2015 Guerard ..... B63B 1/042 114/274

FOREIGN PATENT DOCUMENTS

WO WO-9912804 A1 * 3/1999 ..... B63B 1/042

OTHER PUBLICATIONS https:/www.howardboats.com/my-product/255-VTX-Sport-Deck.com; retrieved from the internet on Aug. 30, 2024 (Year: 2015).*

* cited by examiner

*Primary Examiner* — Anthony D Wiest

(74) *Attorney, Agent, or Firm* — Faegre Drinker Biddle & Reath LLP

(57) ABSTRACT

A hybrid personal watercraft combines features of pontoon boats and deck boats, in a cost-effective and versatile package. The watercraft includes port and starboard sponsons which combine a pair of outboard flotation cavities. A space below the deck and above the hull bottom creates at least one, and potentially up to three additional flotation cavities, which may also be used as storage areas accessible by an access door in the bow of the watercraft and/or a set of hatches in the deck. The watercraft may be efficiently produced assembled from polymer materials, such as thermoplastic polyolefin (TPO).

24 Claims, 13 Drawing Sheets

PERSONAL WATERCRAFT

CROSS-REFERENCE TO RELATED APPLICATION

This application claims the benefit of U.S. Provisional Application Ser. No. 63/152,685 filed Feb. 23, 2021 and entitled PERSONAL WATERCRAFT, the entire disclosure of which is hereby expressly incorporated herein by reference.

BACKGROUND

1. Technical Field

The present disclosure relates to personal watercraft and, in particular, to a hybrid pontoon- and deck-type watercraft.

2. Description of the Related Art

Pontoon boats have two or more longitudinally extending floatation devices, or pontoons, which provide buoyancy sufficient to float the pontoon, a deck mounted atop the pontoons, associated boat equipment including seats and controls, and passengers and cargo. Pontoon boats are favored for their large deck areas, smooth ride, and suitability for shallow-water use, beach-docking capability, and general suitability for small lakes and rivers.

Deck boats generally include a V-shaped hull shaped to "cut" efficiently through the water. Deck boats are favored for their speed and agility, but are less stable and less suitable for shallow waters as compared to pontoon boats.

What is needed is an improvement over the foregoing.

SUMMARY

The present disclosure provides a hybrid personal watercraft which combines features of pontoon boats and deck boats, in a cost-effective and versatile package. The watercraft includes port and starboard sponsons which combine a pair of outboard flotation cavities. A space below the deck and above the hull bottom creates at least one, and potentially up to three additional flotation cavities, which may also be used as storage areas accessible by an access door in the bow of the watercraft and/or a set of hatches in the deck. The watercraft may be efficiently produced assembled from polymer materials, such as thermoplastic polyolefin (TPO).

In one form thereof, the present disclosure provides a personal watercraft including a hull bottom having a fore portion and an aft portion, a port sponson and a starboard sponson each fixed to the hull bottom and extending from the fore portion to the aft portion, a deck fixed to the port sponson and the starboard sponson, the deck spaced above the hull bottom, the deck extending from the fore portion to the aft portion such that the hull bottom, the port sponson, the starboard sponson and the deck cooperating to define a flotation cavity, and a port longitudinal stringer and a starboard longitudinal stringer each fixed to the hull bottom and the deck and positioned within the flotation cavity, the port longitudinal stringer and the starboard longitudinal stringer each extending longitudinally from the fore portion to the aft portion.

In another form thereof, the present disclosure provides a method of assembling a personal watercraft, the method including assembling a pair of sponsons to port and starboard sides of hull bottom, assembling a pair of longitudinal stringers to the hull bottom, such that each of the pair of longitudinal stringers is disposed between, and spaced from, the pair of sponsons, fixing the pair of sponsons and the pair of longitudinal stringers to the hull bottom, and assembling a deck to the pair of sponsons by supporting port and starboard edges of the deck upon port and starboard supporting ledges respectively formed on the pair of sponsons, and sliding the deck along the port and starboard supporting ledges to engage a pair of cutouts formed in an aft portion of the deck with a correspondingly shaped pair of grooves formed in respective aft portions of the pair of sponsons.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein:

Corresponding reference characters indicate corresponding parts throughout the several views. The exemplifications set out herein illustrates embodiments of the invention, the embodiments disclosed below are not intended to be exhaustive or to be construed as limiting the invention. Except as otherwise explicitly stated herein (e.g., for "schematically" illustrated features), FIGS. 1-13 are drawn to scale.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Embodiments may be practiced as methods, systems or devices. Accordingly, embodiments may take the form of a hardware implementation, or an implementation combining software and hardware aspects. The following detailed description is therefore not to be taken in a limiting sense, and the scope of the present disclosure is defined by the appended claims and their equivalents.

Figure 1:
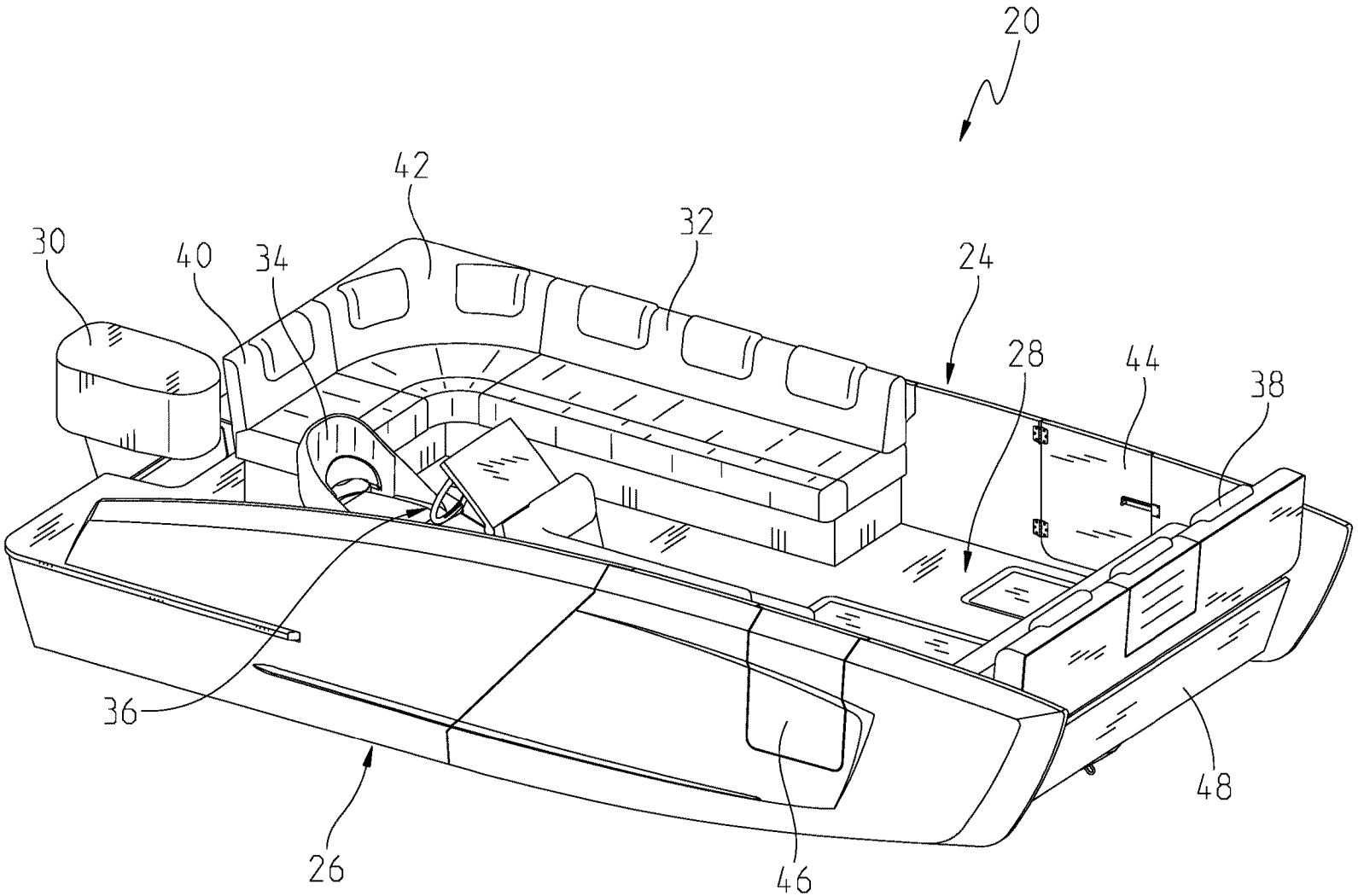
FIG. 1 is a top perspective view of a watercraft made in accordance with the present disclosure.

Turning now to FIG. 1, watercraft 20 is configured as a "hybrid" design which provides stability and passenger capacity similar to a pontoon boat, and the handling, speed and efficiency similar to a deck boat. Watercraft 20 includes port sponson 24 and starboard sponson 26, which provide flotation at the outermost edges of deck 28 extending therebetween. In addition, watercraft includes hull bottom 22 (FIG. 2) which includes a V-shaped hull portion having a keelson 50 as further described below. Between deck 28 and hull bottom 22 are additional watertight compartments 70, 72 and 74 (FIGS. 6 and 12) which provide additional flotation but are also accessible as an under-deck storage space, as also described in detail below.

Figure 4:
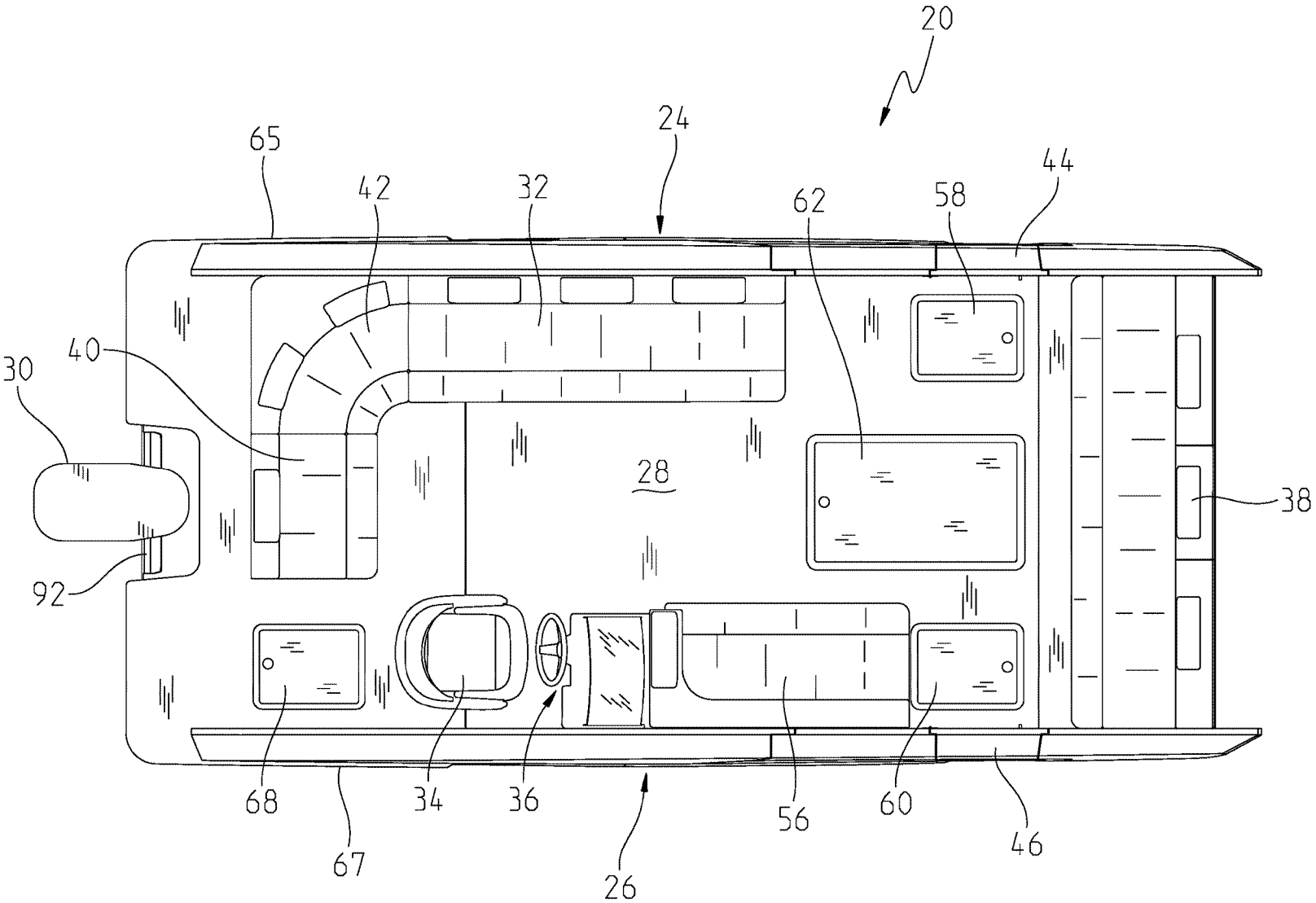
FIG. 4 is a top plan view of the watercraft shown in FIG. 1.
Figure 6:
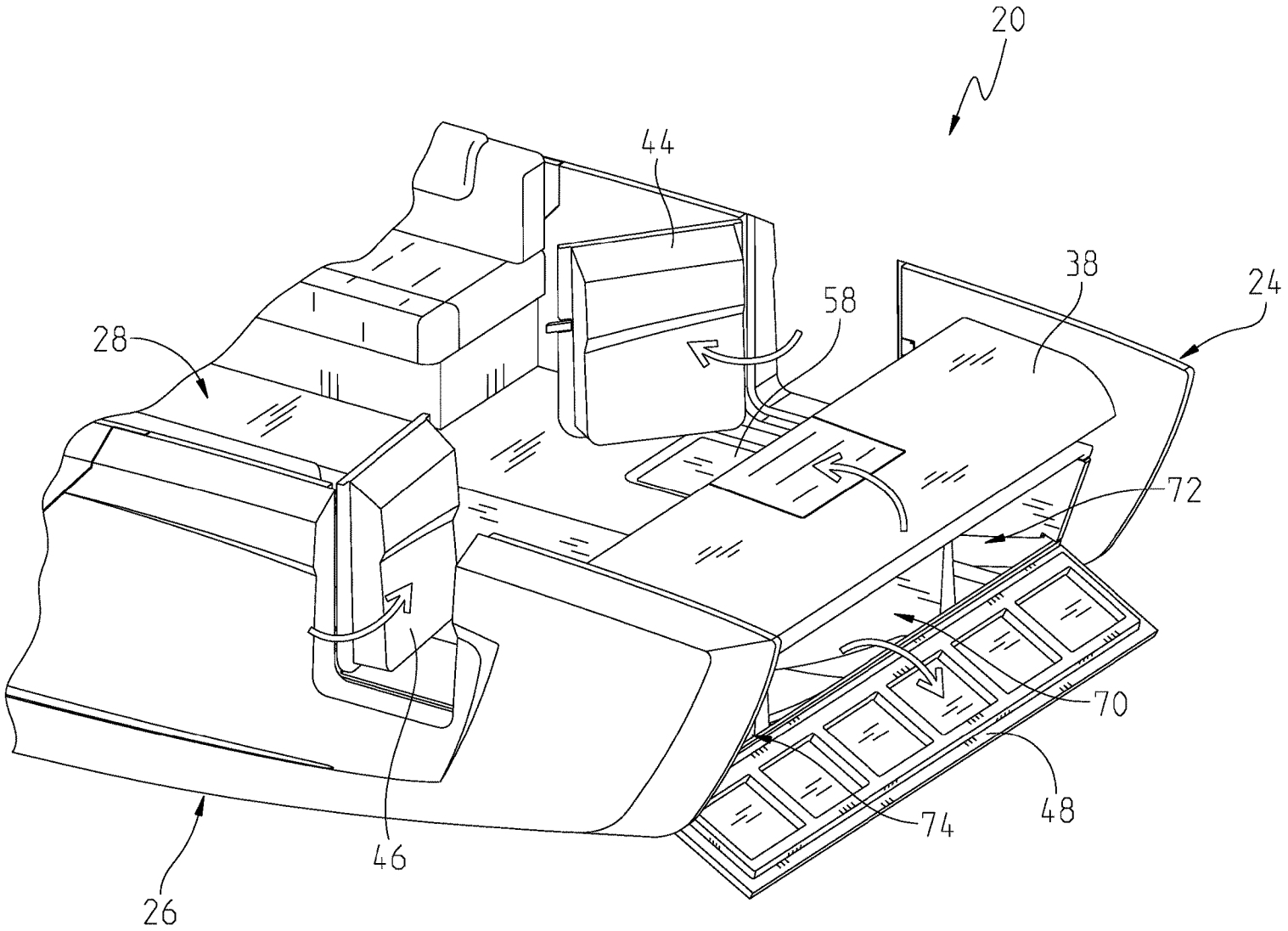
FIG. 6 is a partial, top perspective view of a bow portion of the watercraft shown in FIG. 1.

As best seen in FIG. 4, watercraft 20 is shown to include various seats supported by deck 28 and designed to accommodate several passengers. In the illustrated configuration, watercraft 20 includes an operator seat 34 supported upon deck 28 and positioned on a starboard side thereof. A port side bench seat 32 is positioned along the port side of deck 28 spaced away from the operator seat 34 with an open portion of deck 28 therebetween. Bench seat 32 and extends rearwardly to meet corner seat 42, which is positioned at the port side of the stern. Stern seat 40 is positioned inwardly of corner seat 42 along the stern edge of deck 28. Further seating may be provided by starboard bench seat 56 positioned forward of the operator seat 34 on the starboard side of deck 28. Yet another bench seat 38 may be positioned at the bow, supported by a forward end of deck 28. With this seating arrangement, watercraft 20 may provide seating for an operator and up to 10 passengers in a compact craft, such an 18-foot length as illustrated. Passengers may access or leave the deck 28 of watercraft 20 by port and starboard doors 44, 46, which are hingedly connected to port and starboard sponsons 24, 26 respectively (FIG. 6).

Console 36 is mounted to deck 28 forward of operator seat 34 and configured to be operated by the driver of watercraft 20. In particular, console 36 may include a throttle operably connected to an outboard motor 30 mounted to a transom 92 at the rear of watercraft 20. Console 36 may further include a steering control, such as a steering wheel as illustrated, the allow the operator to control the direction of travel as watercraft 20 is propelled by motor 30 through the water. Console 36 may include additional controls as required or desired for a particular application, such as lighting controls, sound system controls, and the like.

Watercraft 20 may be configured to have other seating arrangements as required or desired for a particular boat layout. For example, console 36 may be moved to the center of deck 28 and additional passenger seating may then be arranged at alternative locations around the periphery of deck 28. In an exemplary embodiment, all seats and the console 36 are mounted directly to deck 28 and supported thereupon in their fixed positions by simply fastening their frames directly to the material of deck 28. As a result, reconfiguration of the seating and console arrangement can be made without the need to reconfigure other components of watercraft 20.

Port sponson 24 and starboard sponson 26 may be mirror images of one another and, accordingly, the structures and details of one sponson 24, 26 described herein also apply to the other sponson 24, 26. Sponsons 24, 26 are each shaped as elongate, substantially flat structures defining an overall height H, shown in FIG. 12 with respect to port sponson 24, that is substantially less than an overall width W. In an exemplary embodiment, the dimension of height H is several times the dimension of width W, such that the ratio of H:W is 4:1, 5:1, 6:1, 7:1 or 8:1. In the illustrative embodiment of FIG. 12, which is drawn to scale, H:W is about 6:1.

Figure 12:
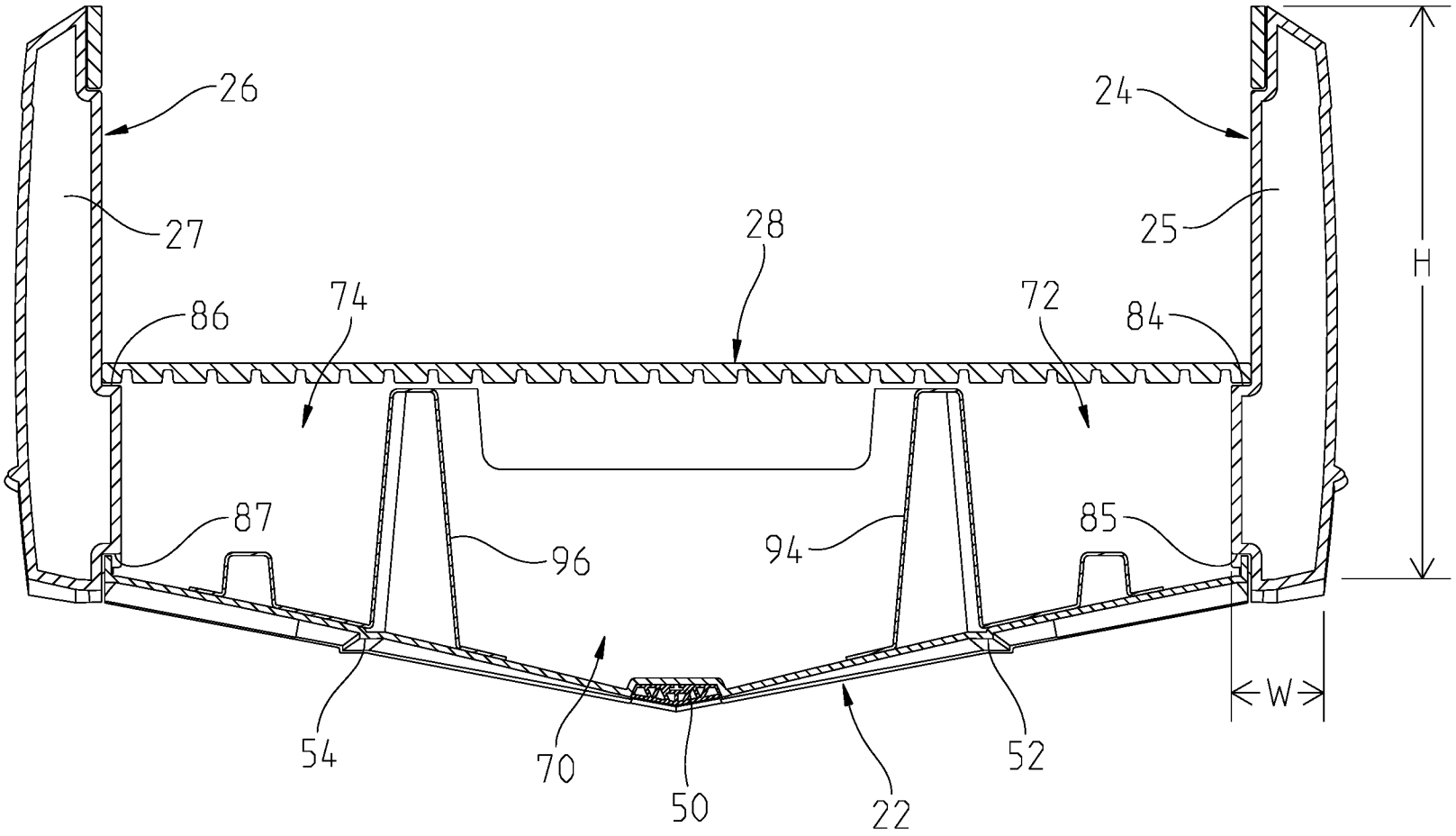
FIG. 12 is a front elevation, cross-section view of the assembled hull components shown in FIG. 11, taken along the line 12-12 of FIG. 11.
Figure 13:
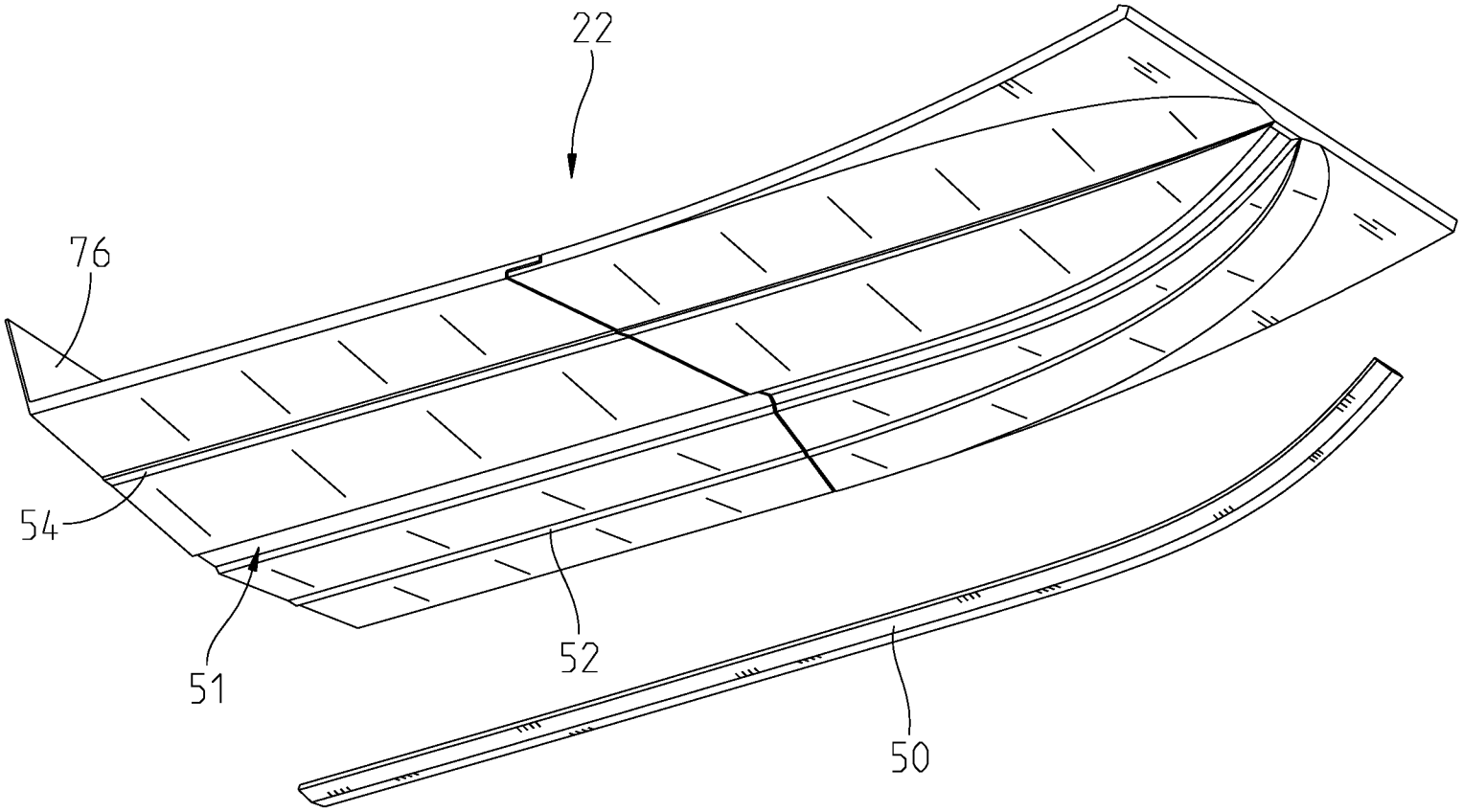
FIG. 13 is a bottom perspective view of the hull bottom component of the components shown in FIG. 7, further illustrating a replaceable keelson.

Sponsons 24, 26 also include respective hollow cavities 25, 27, shown in FIG. 12, which extend along the length of each of sponsons 24, 26 and provide buoyancy to sponsons 24 and 26. Cavities 25, 27 form hermetically sealed chambers filled with buoyant, low-density foam, air or another gas, or any other suitable buoyant material.

The tall, narrow, and hollow configuration of sponsons 24, 26 provides a hydrodynamic shape for low-resistance passage through water, and provides a significant amount of buoyancy at the far exterior edges of deck 28, thereby maximizing stability.

Figure 2:
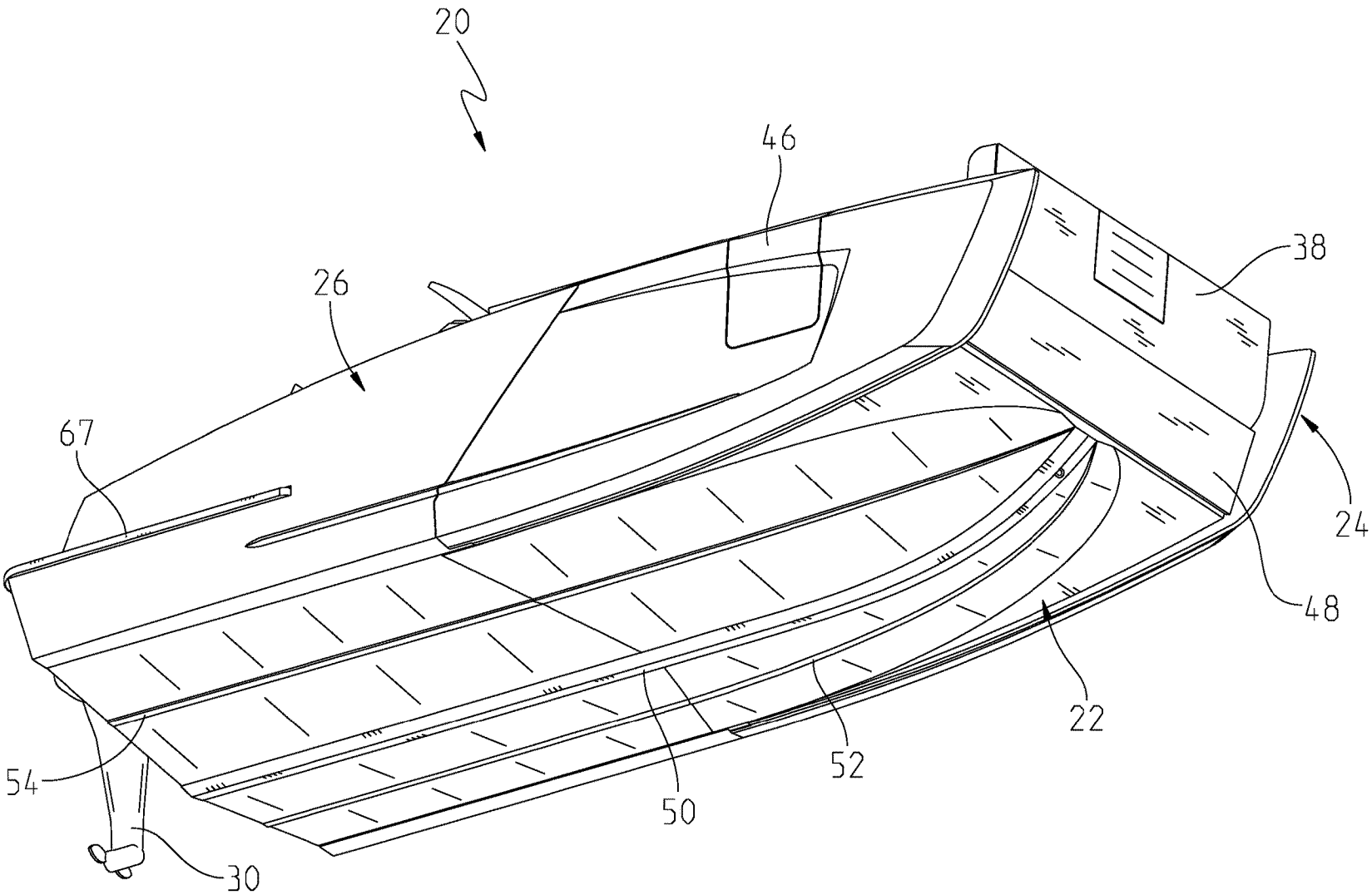
FIG. 2 is a bottom perspective view of the watercraft shown in FIG. 1.
Figure 3:
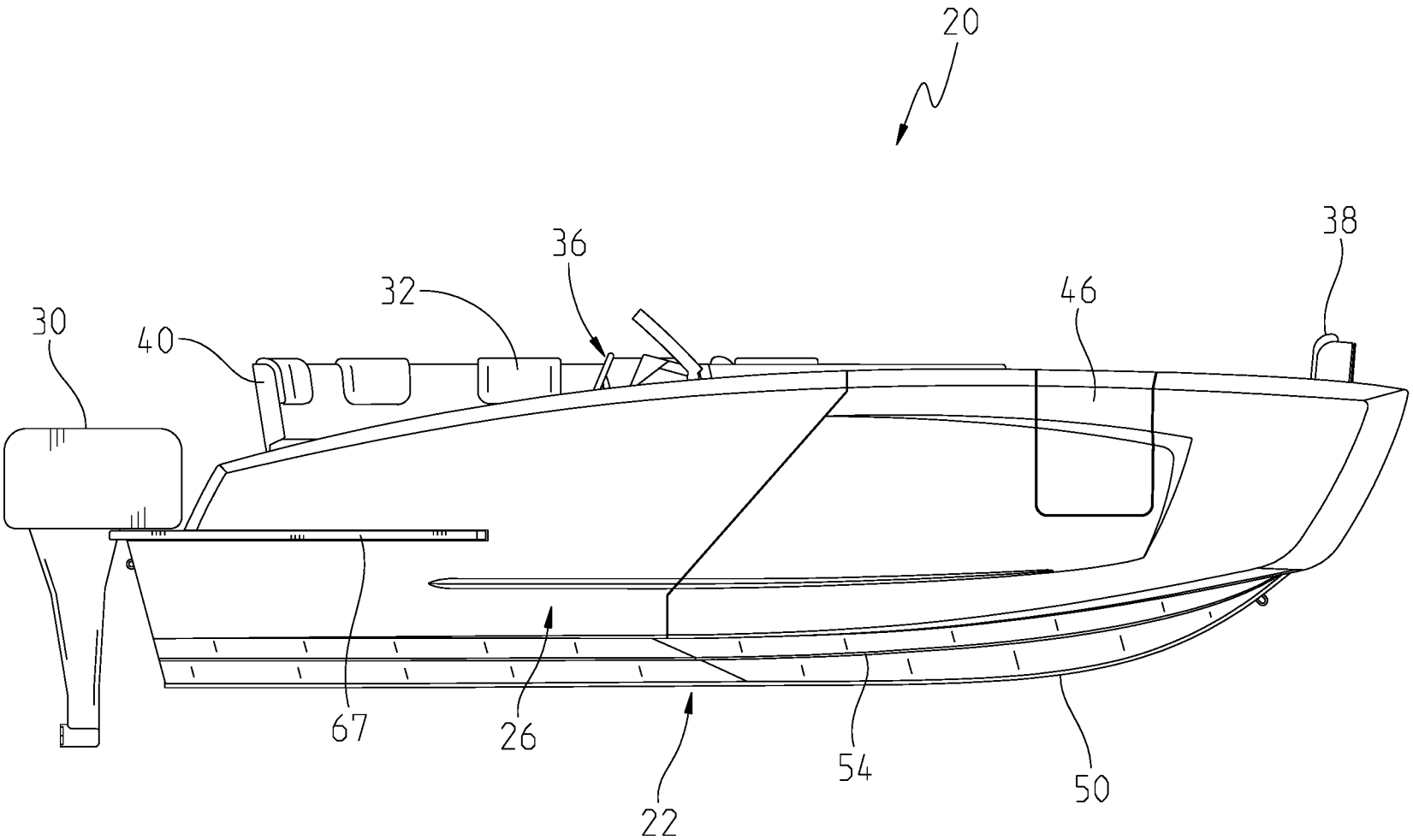
FIG. 3 is a starboard-side elevation view of the watercraft shown in FIG. 1.

Sponsons 24, 26 respective fixed to port and starboard edges of hull bottom 22, as shown in FIG. 2 and described in further detail below, so that hull bottom 22 runs substantially the full length (e.g., more than 90%) of watercraft 20, from fore to aft. In an exemplary embodiment, port sponson 24 includes a lower supporting ledge 85 (FIGS. 7 and 12) formed along its interior surface, which creates an angled abutment against which the port edge of hull bottom 22 nests. This port edge may be joined to lower supporting ledge 85 by thermal welding and/or adhesive bonding, as further described below. The starboard edge of hull bottom 22 similarly joins to a starboard lower supporting ledge 87, as best seen in FIG. 12.

In the illustrated embodiment, the fore portion of hull bottom 22 is joined to the aft portion of hull bottom 22 by a lap-joint seam, in order to facilitate manufacture of hull bottom 22. Sponsons 24, 26 may be similarly joined along their fore/aft length as illustrated. However, hull bottom 22 and sponsons 24, 26 may be made as single pieces without any seam or lap joint, depending on the tooling used for production.

Deck 28 is also fixed along its port and starboard edges to port and starboard sponsons 24, 26 respectively, such that deck 28 also runs substantially the full length (e.g., more than 90%) of watercraft 20, from fore to aft. Port and starboard sponsons 24, 26 respectively include upper supporting ledges 84, 86, and the corresponding port and starboard edges of deck 28 are supported by, and fixed to, ledges 84, 86 in the same manner as discussed above with respect to the fixation of hull bottom 22 to sponsons 24 and 26.

Hull bottom 22 and deck 28 forms upper and lower boundaries of a flotation cavity between the sponsons 24 and 26. This flotation cavity is in addition to the flotation provided by sponsons 24, 26 and provides additional buoyancy to watercraft 20. As further described below, this flotation space may also be made accessible through a selectively sealed access panel 48 at the bow of watercraft 20 (FIG. 6), and through various selectively sealed hatches 58, 60, 62 and 68 in deck 28 (FIG. 4).

A framework of stringers is located within the flotation cavity to provide additional structural support and rigidity to the hull of watercraft 20. A pair of longitudinal stringers provides the backbone of this framework, including a port-side stringer 94 and a starboard-side stringer 96. Stringers 94, 96 run the length of the flotation cavity and, therefore, also run substantially the full length (e.g., more than 90%) of watercraft 20, from fore to aft. Stringers 94 and 96 extend vertically between, and are fixed to, hull bottom 22 and deck 28 as best seen in FIG. 12.

Figure 7:
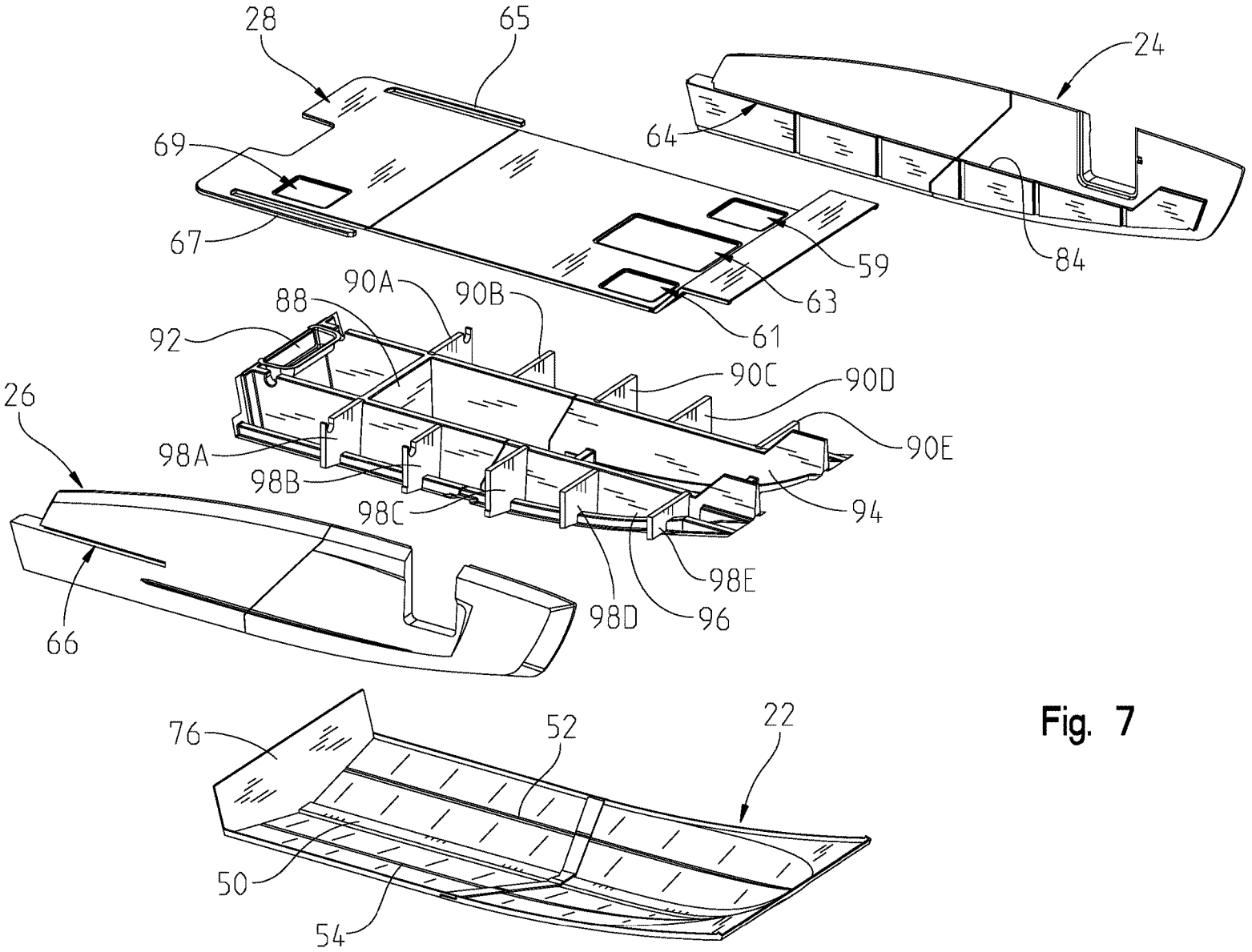
FIG. 7 is an exploded, top perspective view of hull components of the watercraft shown in FIG. 1.

An arrangement of lateral stringers cooperates with longitudinal stringers 94, 96 to complete the stringer framework. As best seen in FIG. 7, a plurality of port stringers 90A-90E each extend from an inboard end, fixed to port longitudinal stringer 94, to an outboard end fixed to the interior surface of port sponson 24. Stringer 90A is spaced longitudinally from stringer 90B to create a fore/aft space therebetween. Stringers 90C, 90D and 90E are similarly longitudinally spaced from one another as illustrated. A plurality of starboard stringers 98A-98E are similarly arranged and affixed between starboard stringer 96 and starboard sponson 26.

A central lateral stringer 88 also extends between, and is fixed to, the starboard longitudinal stringer 96 and the port longitudinal stringer 94. Transom portion 92 operates as both a lateral stringer, connecting the aft ends of longitudinal stringers 94, 96, and also as a support for the mounting structure for motor 30.

Figure 9:
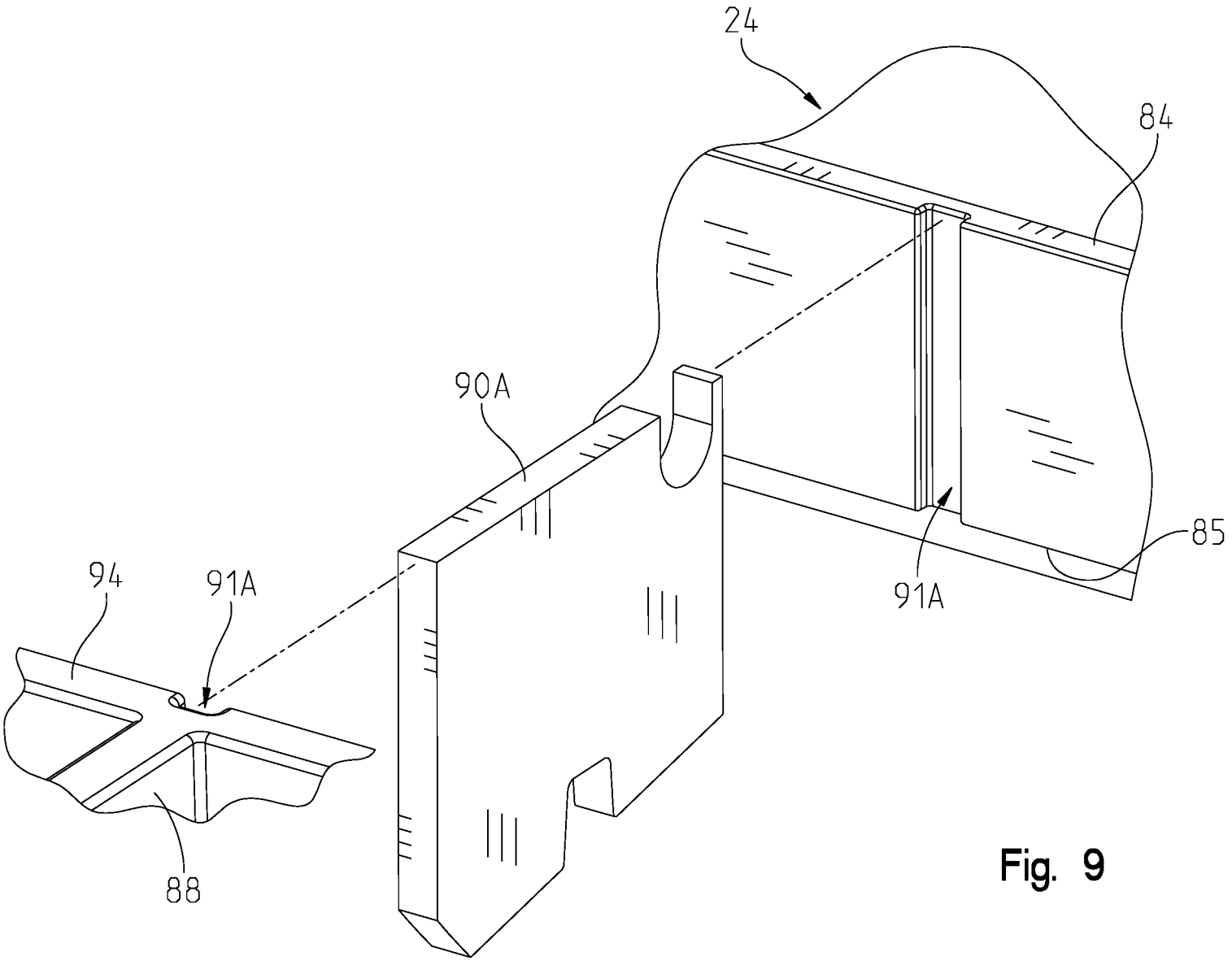
FIG. 9 is an exploded perspective, detail view of a stringer junction of the hull assembly shown in FIG. 8.

FIG. 9 is an exploded view illustrating the junction between lateral stringer 90A, sponson 24 and longitudinal stringer 94. Sponson includes a vertical pocket 91A, extending vertically from upper ledge 84 to lower ledge 85, which is sized to receive the adjacent end of stringer 90A. A second pocket 91A is formed in longitudinal stringer 94 and receives the opposing end of stringer 90A. Pockets 91A may locate and retain stringer 90A relative to sponson 24 and longitudinal stringer 94 during the final welding/adhesive attachment described further below. The other lateral stringers 90B-90E and 98A-98E, and central stringer 88, may be similarly received within pockets 91A.

Figure 10:
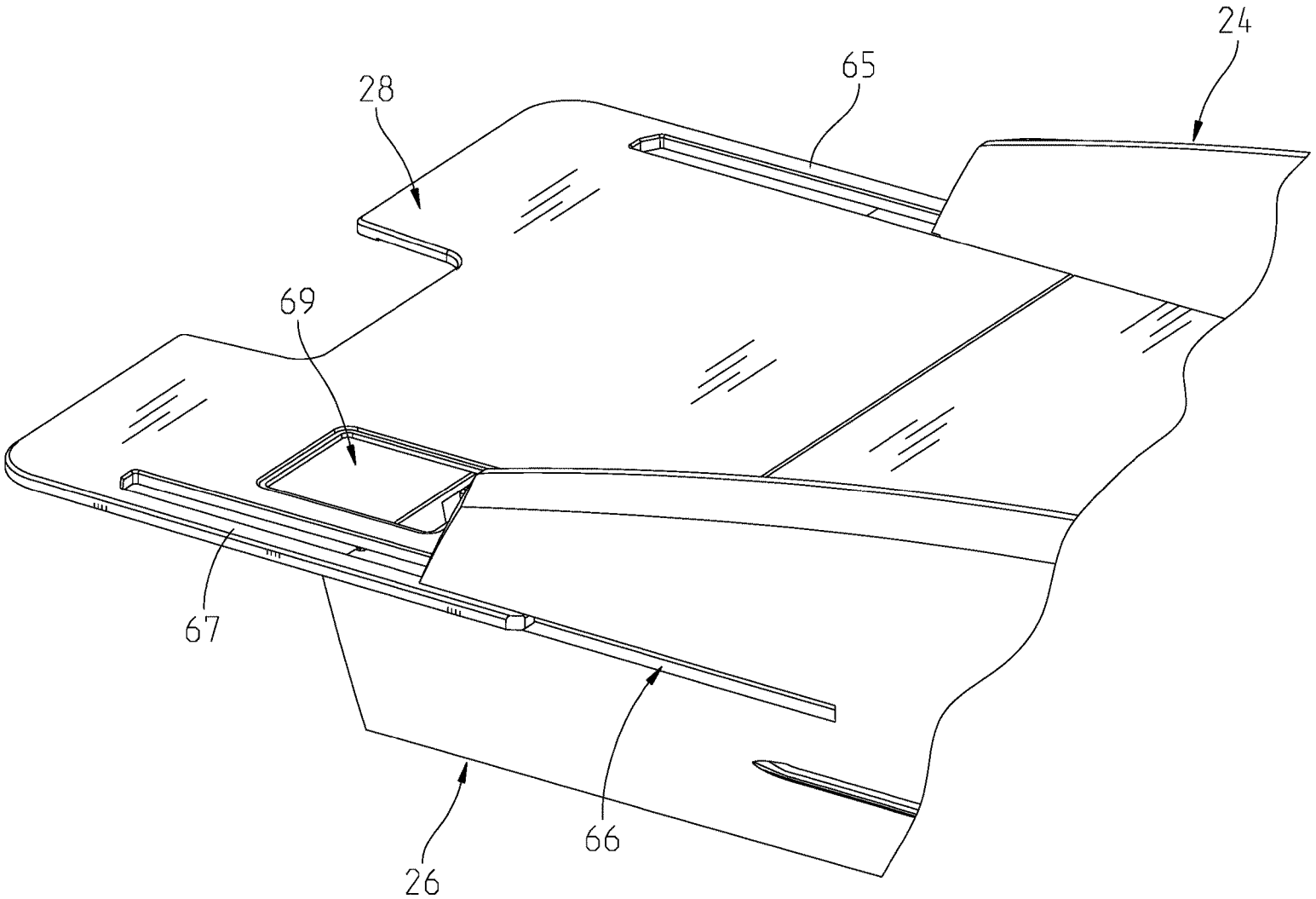
FIG. 10 is an exploded perspective, detail view of the installation of the deck to the hull assembly shown in FIG. 8.

Deck 28 is supported by ledges 84, 86 as described above and shown in FIG. 12. With reference to FIG. 10, deck 28 is further oriented and retained by the interaction of port and starboard keys 65 and 67, which are slideably received within port and starboard grooves 64 and 66 (port groove 64 is a mirror image of starboard groove shown in FIG. 10). Grooves 64, 66 extend forwardly from respective aft edges of sponsons 24, 26. During installation and as further described below, deck 28 may be slid forwardly along ledges 84 and 86 as keys 65 and 67 are advanced along grooves 64 and 66. When deck 28 is fully installed, keys 65, 67 are fully seated within grooves 64, 66 respectively.

Turning now to FIGS. 2 and 12, the V-shaped hull portion 22 is shown in detail. This shallow draft V-shape, which is shown to scale, is designed to impart handling characteristics to watercraft 20 which are similar to traditional deck boats, such as runabout style boats. Hull portion 22 includes keelson 50, which may be an extruded rubber strip of material designed to be fixed within a correspondingly shaped groove in hull bottom 22. Keelson 50 extends along the fore/aft direction and is centered around a lateral midplane equidistant from the port sponson 24 and the starboard sponson 26, and may be replaceable in the case of damage (e.g., from running watercraft 20 aground).

Hull portion further includes port and starboard portions extending laterally and upwardly from keelson 50 to respective port and starboard junctions with lower portion of the port and starboard sponsons 24 and 26. The port hull portion includes a port spray rail 52, and the starboard portion includes a starboard spray rail 54 which may be a mirror image of port rail 52. In an exemplary embodiment, spray rails 52, 54 may present surfaces which face straight down or inwardly by up to 5 degrees away from horizontal, form sharp edges as they transition back to the otherwise outwardly-facing surface of the hull portion. Similarly sharp edges may be formed at the lower/outer edges of sponsons 24, 26, as best seen in FIG. 12. These sharp edges may enhance the handling of watercraft 20.

As best seen in FIG. 2, spray rails 52 and 54 each extend along an arcuate path from a fore end near the bow of watercraft 20, proximate keelson 50, and an aft end proximate the stern of watercraft 20, adjacent transom portion 76 of hull bottom 22 (FIG. 7). Transom portion 76 extends upwardly from the aft end of hull bottom 22, and extends between and fixed to port sponson 24 and starboard sponson 26 in the same manner as the other portions of the edges of hull bottom 22. In the illustrated embodiment, transom portion 76 forms an aft bounding surface of the flotation cavity between the aft ends of sponsons 24, 26.

Figure 5:
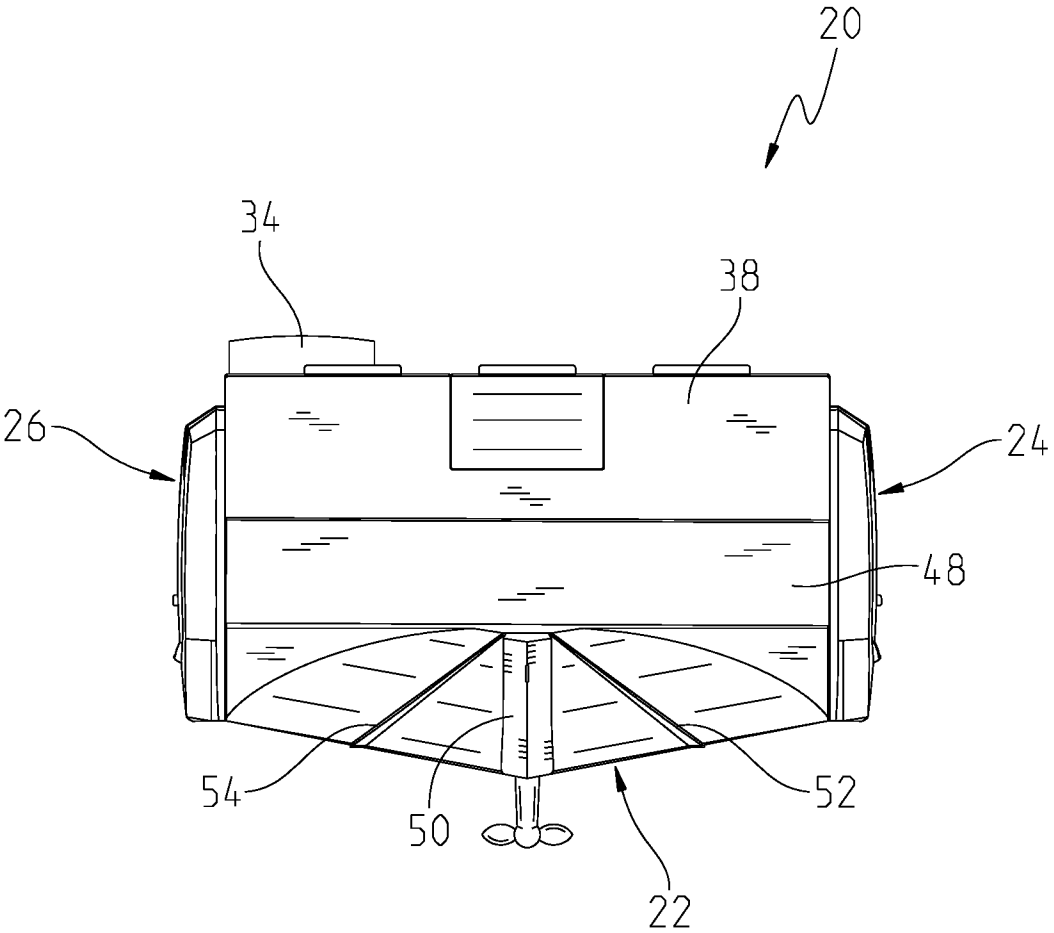
FIG. 5 is a front elevation view of the watercraft shown in FIG. 1.

Turning to FIG. 6, watercraft 20 includes an access panel 48 at the bow which can hinge between an open position (FIG. 6) and a closed position (FIGS. 1, 2 and 5). Access panel 48 spans the full width between sponsons 24 and 26 and is pivotably connected thereto, such that pivoting open access panel 48 offers access to all three interior cavities 70, 72 and 74 between the hull bottom 22 and deck 28. In some embodiments, one or more of cavities 70, 72, 74 is filled with foam to provide flotation, such as port and starboard cavities 72 and 74. Central cavity 70 may then be used for storage. In other embodiments, all three cavities 70, 72 and 74 may be open and allow for storage.

Access panel 48 pivots to a closed and sealed position (FIGS. 1, 2 and 5) such that water may not enter cavities 70, 72 or 74 during operation of watercraft 20. In an exemplary embodiment, a latch or series of latches (not shown) are used to ensure that access panel 48 remains closed when watercraft 20 is operational.

As noted above, cavities 70, 72 or 74 are also accessible from above through one or more hatches which selectively sealingly enclose apertures formed through deck 28. In the illustrative embodiment of FIG. 7, deck 28 includes a port hatch aperture 59, a starboard hatch aperture 61 and a central aperture 63 all positioned at the fore end of deck 28. An aft aperture 69 is also located on the starboard side aft of the operator seat 34 (FIG. 4). Port aperture 59 and starboard apertures 61 and 69 are sized to access relatively smaller lateral spaces between longitudinal stringers 94, 96 and the adjacent sponson 24, 26, and also the longitudinal spaces between respective lateral stringers. Central aperture 63 is larger to access the larger space between longitudinal stringers 94 and 96 and forward of central lateral stringer 88. As best seen in FIG. 4, hatches 58, 60, 62 and 68 are selectively sealingly received within apertures 59, 61, 63 and 69, respectively to hermetically enclose the flotation cavities when closed. In an exemplary embodiment, hatches 58, 60, 62 and 68 are hingedly connected to deck 28.

As best seen by a comparison of FIGS. 1 and 6, fore seat 38 is pivotable between an use configuration (FIG. 1) and a stowed configuration (FIG. 6). In the seating configuration, the seat back is pivoted up into a generally upright orientation such that the seat back surface extends upwardly away from the seat base. In the stowed configuration, the seat back is pivoted down such that the seat back surface is generally horizontal and adjacent (e.g., abutting) the seat base surface. When stowed, the operator seated at operator seat 34 has an improved line of sight across the bow of watercraft 20.

In one embodiment, many of the components making up the hull of watercraft 20 are formed of a common polymer material, such as thermoplastic polyolefin (TPO). For example, many of the various components may be made of a single, monolithic piece of solid material which can be thermally welded and/or adhered to one another for an efficient, low-cost and fast assembly process.

Sponsons 24 and 26 may each be made of a single, solid unitary and monolithic piece of material which may be twin-sheet formed by a vacuum-forming process. As noted above, sponsons 24 and 26 may also be made as an aft section and a fore section which are each single monolithic pieces of TPO, which are then joined to one another along a mid-plane seam. Sponsons 24 and 26 may be prepared in a factory setting with high tolerance and quality controls, and shipped or moved to another location for assembly.

Hull bottom 22, deck 28 and longitudinal stingers 94, 96 may also be made of a single, solid unitary and monolithic piece of material, such as TPO. In the illustrated embodiment, hull bottom 22 and longitudinal stingers 94, 96 are made as an aft section and a fore section joined along a mid-plane, which allows for smaller and less expensive tooling, but single solid pieces may also be made. These components may all be efficiently transported from a production facility to an assembly facility, if desired.

In some alternative embodiments, watercraft 20 may be modularly elongated from, e.g., an 18-foot craft to a 20-foot, 22-foot or 24-foot craft, or any other desired length, by adding additional middle sections to existing aft and fore sections of hull bottom 22, deck 28, and longitudinal stingers 94, 96. In this way, crafts of various lengths can be assembled for "just in time" delivery from existing preformed, modular components.

Figure 8:
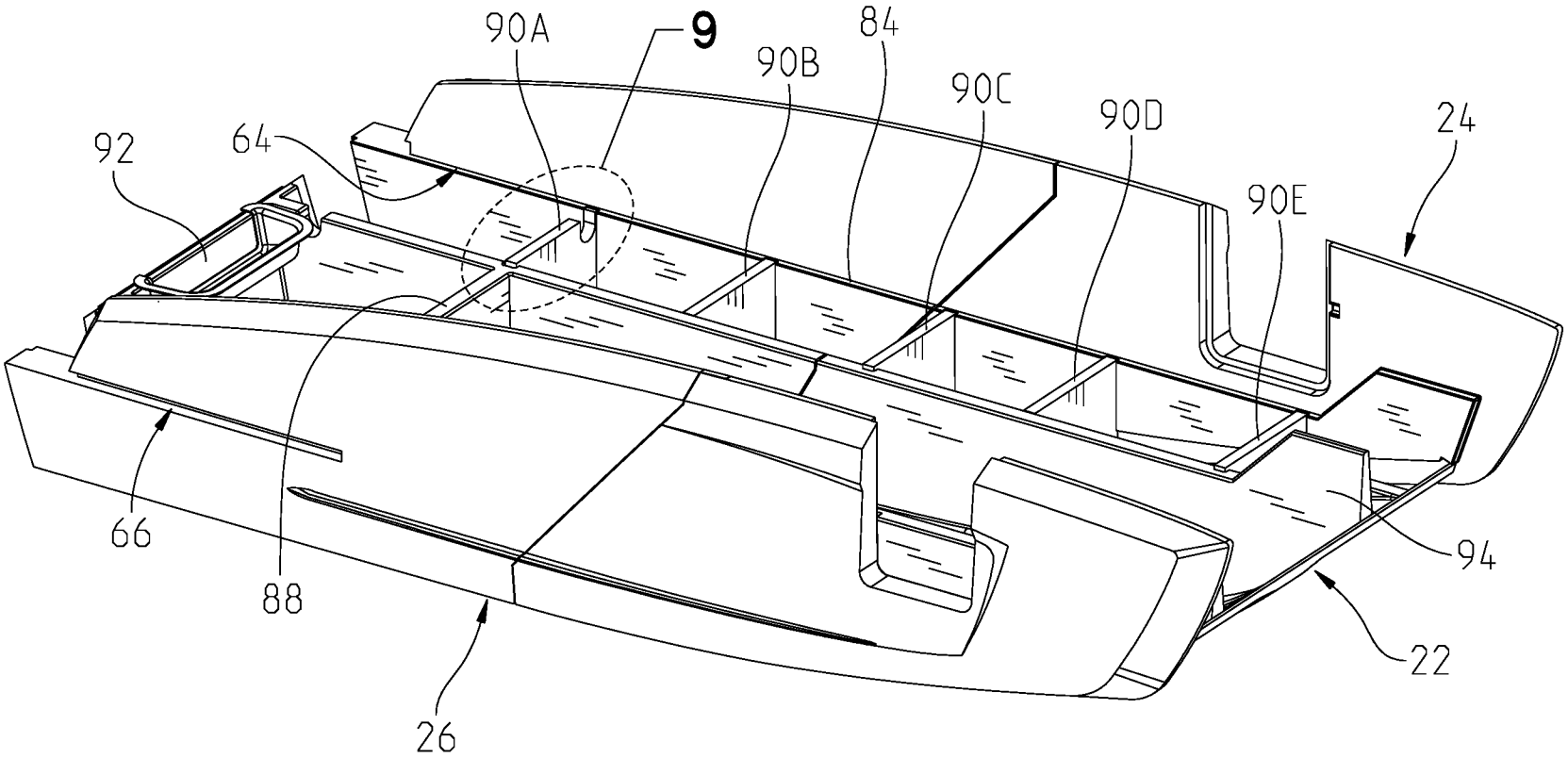
FIG. 8 is an assembled, top perspective view of the hull components shown in FIG. 7, excluding the deck component thereof.

Assembly of watercraft 20 may begin by assembling port and starboard sponsons 24, 26 to port and starboard sides of hull bottom 22, respectively, such as along lower ledges 85, 87 as described above. Then, longitudinal stringers 94, 96 are assembled to hull bottom 22, such that each of the longitudinal stringers 94, 96 is disposed between, and spaced laterally apart from, the sponsons 24 and 26 as shown in FIG. 8. Keelson 50 may be installed to the bottom of hull 22 at this time, or at any other time after the hull bottom 22 is completed.

At this point, the various joints between the components may be joined by thermal welding and/or adhesive to fix each of the components to the abutting component. Where adhesive is used, methyl methacrylate adhesives (MMA) such as Plexus brand adhesive may be used to create a strong bond.

Figure 11:
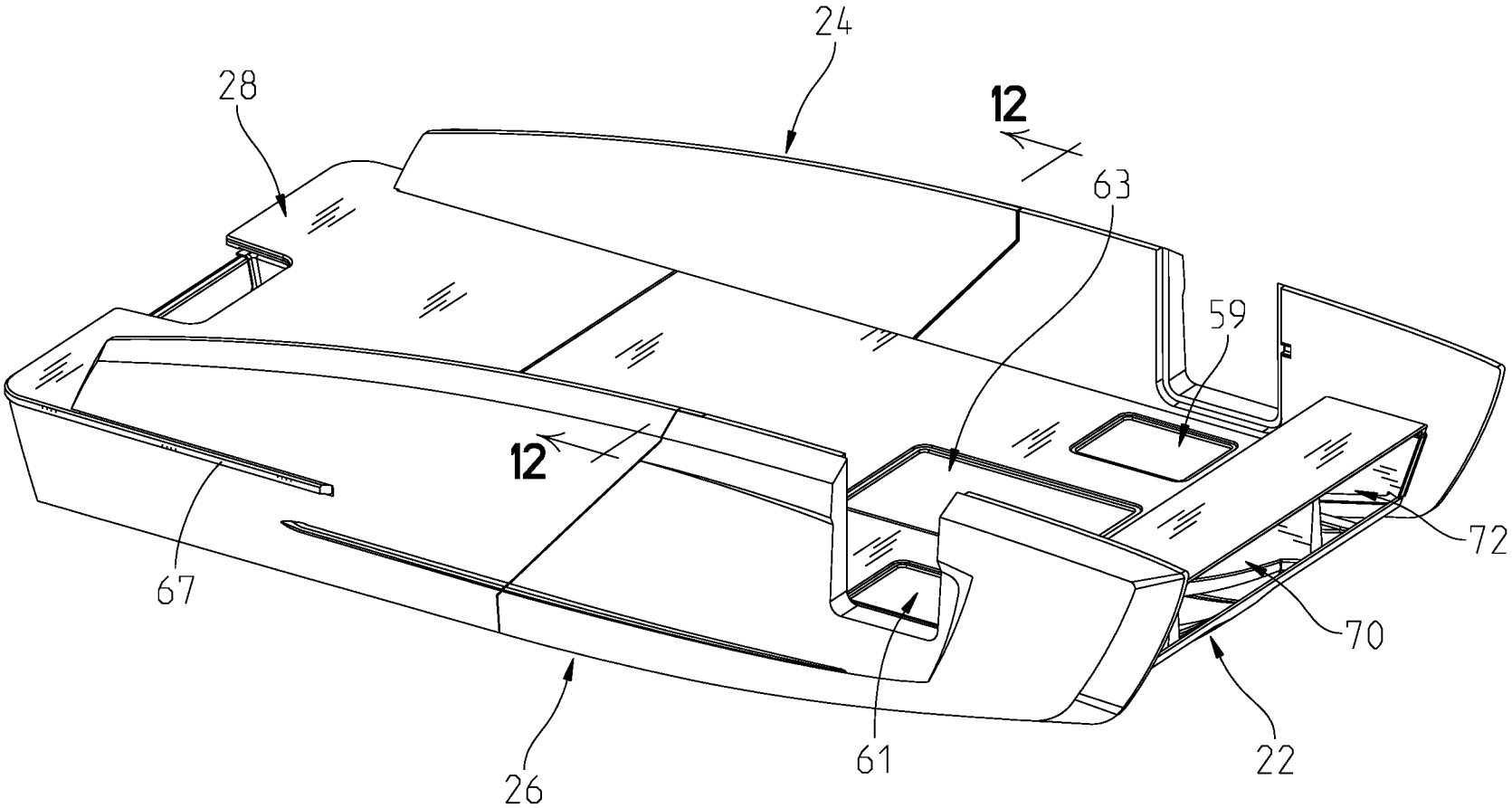
FIG. 11 is assembled, top perspective view of the hull components shown in FIG. 7.

With the basic structure of the hull of watercraft 20 completed as shown in FIG. 8, deck 28 may be installed. As noted above, deck 28 is assembled to sponsons 24, 26 by first supporting a forward portion of the port and starboard edges of deck 28 upon port and starboard supporting ledges 84, 86. Deck 28 is then slid along the port and starboard supporting ledges 84, 86 until keys 65, 67 formed in the aft portion of deck 28 engage their respective grooves 64, 66 formed in respective aft portions of sponsons 24, 26 (FIG. 10). The installer continues sliding deck 28 forward as keys 65, 67 slide forward within grooves 64, 66 until fully seated (FIG. 11). Deck 28 is then fixed to sponsons 24 and 26 by welding and/or adhesive as described above.

Deck hatches 58, 60, 62 and 68 may then be installed within their respective apertures 59, 61, 63 and 69 formed in the deck 28, such as by installing hinges and, as needed, gaskets to make watertight connections. Access panel 48 is pivotably attached to sponsons 24 and 26 (FIG. 6) with latches and/or gaskets to ensure a locked, watertight fit with its adjacent components. Doors 44 and 46 may be installed to sponsons 24, 26 respectively, via hinges and latches.

As shown in FIG. 4, operator seat 34, console 36 and the various passenger seats 32, 42, 40, 56 and 38 may then be installed upon and fixed (e.g., by fasteners) to deck 28. Electrical wiring can be installed in a conventional manner. As noted above, these components may be installed as shown or in an alternative spatial arrangement. Motor 30 is mounted to transom 92 and operably connected to a throttle of console 36 as noted above.

Watercraft 20 may be wrapped and, in some instances, placed upon a dedicated trailer for shipment to a dealer or customer as a boat/trailer combination.

While this invention has been described as having exemplary designs, the present invention may be further modified with the spirit and scope of this disclosure. Further, this application is intended to cover such departures from the present disclosure as come within known or customary practice in the art to which this invention pertains.

What is claimed is:

1. A personal watercraft comprising:

a hull bottom having a fore portion and an aft portion;

a port sponson and a starboard sponson each fixed to the hull bottom and extending from the fore portion to the aft portion, the port sponson including a port groove extending forwardly from an aft edge thereof, and the starboard sponson including a starboard groove extending forwardly from an aft edge thereof; and a deck fixed to the port sponson and the starboard sponson, the deck spaced above the hull bottom, the deck extending from the fore portion to the aft portion such that the hull bottom, the port sponson, the starboard sponson and the deck cooperating to define a flotation cavity, and the deck including a port key sized to be slideably received within the port groove and a starboard key sized to be slideably received within the starboard groove.

2. The personal watercraft of claim 1, further comprising:

a port longitudinal stringer and a starboard longitudinal stringer each fixed to the hull bottom and the deck and positioned within the flotation cavity, the port longitudinal stringer and the starboard longitudinal stringer each extending longitudinally from the fore portion to the aft portion.

3. The personal watercraft of claim 2, further comprising:

a plurality of lateral stringers each having a first end fixed to one of the port sponson and the starboard sponson, and a second end fixed to one of the port longitudinal stringer and the starboard longitudinal stringer.

4. The personal watercraft of claim 3, wherein the plurality of lateral stringers comprises:

a plurality of port lateral stringers each extending from the port sponson to the port longitudinal stringer, the plurality of port lateral stringers spaced longitudinally from one another; and a plurality of starboard lateral stringers each extending from the starboard sponson to the starboard longitudinal stringer, the plurality of starboard lateral stringers spaced longitudinally from one another.

5. The personal watercraft of claim 4, wherein the plurality of lateral stringers comprises:

at least one central lateral stringer extending from the starboard longitudinal stringer to the port longitudinal stringer.

6. The personal watercraft of claim 2, wherein the deck includes a plurality of apertures formed therethrough, the personal watercraft further including a plurality of hatches configured to selectively sealingly enclose respective ones of the plurality of apertures.

7. The personal watercraft of claim 2, wherein the plurality of apertures includes:

at least one central deck aperture positioned between the port longitudinal stringer and the starboard longitudinal stringer, whereby the central deck aperture provides access to a central portion of the flotation cavity;

at least one port deck aperture positioned between the port longitudinal stringer and the port sponson, whereby the port deck aperture provides access to a port portion of the flotation cavity; and at least one starboard deck aperture positioned between the starboard longitudinal stringer and the starboard sponson, whereby the starboard deck aperture provides access to a starboard portion of the flotation cavity.

8. The personal watercraft of claim 1, wherein the hull bottom, the port sponson, the starboard sponson, the deck, the port longitudinal stringer and the starboard longitudinal stringer are each formed as a single unitary piece made as a single monolithic structure.

9. The personal watercraft of claim 8, wherein each single unitary piece is made from thermoplastic polyolefin (TPO).

10. The personal watercraft of claim 1, wherein the hull further comprises:

a keelson extending along a fore/aft direction and centered around a lateral midplane equidistant from the port sponson and the starboard sponson;

a port hull portion extending laterally and upwardly from the keelson to a junction with a lower portion of the port sponson; and a starboard hull portion extending laterally and upwardly from the keelson to a junction with a lower portion of the starboard sponson.

11. The personal watercraft of claim 10, wherein the hull further comprises a transom portion extending upwardly from an aft end, the transom portion extending between and fixed to the port sponson and the starboard sponson such that the transom portion forms an aft bounding surface of the flotation cavity.

12. The personal watercraft of claim 11, wherein the port hull portion includes a port spray rail and the starboard hull portion includes a starboard spray rail, the port spray rail and the starboard spray rail each extending along a first arcuate path from a fore end proximate the keelson and an aft end proximate the transom portion.

13. The personal watercraft of claim 1, wherein:

the port sponson includes a port supporting ledge on an inboard surface thereof and extending forward from a forward end of the port groove, a port edge of the deck supported by the port supporting ledge; and the starboard sponson includes a starboard supporting ledge formed on an inboard surface thereof and extending forward from a forward end of the starboard groove, a starboard edge of the deck supported by the starboard supporting ledge.

14. The personal watercraft of claim 1, further comprising:

an operator seat supported upon the deck;

a console positioned forward of the operator seat and including a steering control and a throttle control;

at least one passenger seat spaced from the operator seat; and a motor operably connected to at least the throttle control.

15. The personal watercraft of claim 14, wherein the at least one passenger seat includes an aft seat positioned proximate a stern of the personal watercraft and a fore seat positioned proximate a bow of the personal watercraft.

16. The personal watercraft of claim 15, wherein the fore seat includes a seat back that is pivotable between a use position, in which the seat back is generally upright and extends upwardly away from a seat base, and a stowed position, in which the seat back is generally horizontal and adjacent the seat base.

17. The personal watercraft of claim 14, wherein at least one of the port sponson and the starboard sponson includes a door opening formed through sponson sidewalls with a door hingedly connected to the door opening, the door opening sized to allow passage of a person therethrough.

18. The personal watercraft of claim 1, further comprising a front access panel hingedly connected to the port sponson and the starboard sponson, the front access panel selectively enclosing a front portion of the flotation cavity.

19. A method of assembling a personal watercraft, the method comprising:

assembling a pair of sponsons to port and starboard sides of hull bottom;

assembling a pair of longitudinal stringers to the hull bottom, such that each of the pair of longitudinal stringers is disposed between, and spaced from, the pair of sponsons;

fixing the pair of sponsons and the pair of longitudinal stringers to the hull bottom; and assembling a deck to the pair of sponsons by supporting port and starboard edges of the deck upon port and starboard supporting ledges respectively formed on the pair of sponsons, and sliding the deck along the port and starboard supporting ledges to engage a pair of keys formed in an aft portion of the deck with a correspondingly shaped pair of grooves formed in respective aft portions of the pair of sponsons.

20. The method of claim 19, further comprising:

assembling a starboard plurality of lateral stringers between a starboard one of the pair of sponsons and a starboard one of the pair of longitudinal stringers;

assembling a port plurality of lateral stringers between a port one of the pair of sponsons and a port one of the pair of longitudinal stringers; and assembling a central plurality of lateral stringers between the starboard one of the pair of longitudinal stringers and the port one of the pair of longitudinal stringers.

21. The method of claim 19, wherein the step of fixing comprises thermal welding or adhesively bonding the pair of sponsons and the pair of longitudinal stringers to the hull bottom.

22. The method of claim 19, further comprising assembling deck hatches to respective apertures formed in the deck.

23. The method of claim 19, further comprising:

assembling an operator seat to the deck;

assembling a console to the deck forward of the operator seat, the console including a steering control and a throttle control; and assembling at least one passenger seat to the deck in a position spaced from the operator seat.

24. The method of claim 23, further comprising:

assembling a motor to a transom of the personal watercraft; and operably connecting the motor to at the least the throttle control.

* * * * *